US005249787A

United States Patent [19]

Ifkovits

[11] Patent Number: 5,249,787

[45] Date of Patent: Oct. 5, 1993

[54] MODULAR DOCUMENT FEEDER DEVICE

[75] Inventor: Edward M. Ifkovits, New Fairfield, Conn.

[73] Assignee: Pitney Bowes Inc., Stamford, Conn.

[21] Appl. No.: 891,104

[22] Filed: Jun. 1, 1992

[51] Int. Cl.[5] ..... B65H 5/02

[52] U.S. Cl. ..... 271/6; 271/35; 271/117; 271/273

[58] Field of Search ..... 271/10, 6, 7, 34, 35, 271/117, 273

[56] References Cited

U.S. PATENT DOCUMENTS

| | | | |
|---|---|---|---|
| 2,273,280 | 4/1941 | Mayer | 271/35 |
| 2,273,287 | 1/1941 | Rouan et al. | 271/35 |
| 2,273,288 | 2/1941 | Rouan et al. | 271/35 |
| 3,032,338 | 6/1958 | Anderson et al. | 271/36 |
| 4,232,860 | 10/1978 | Brown | 271/119 |
| 4,666,140 | 7/1985 | Godlewski | 271/35 |
| 4,715,593 | 1/1987 | Godlewski | 271/10 |
| 4,772,004 | 5/1986 | Golicz | 271/3.1 |
| 4,978,114 | 12/1990 | Holbrook | 271/35 |
| 5,011,124 | 2/1990 | Sardano et al. | 271/35 |
| 5,033,729 | 12/1989 | Struthers | 271/10 |
| 5,152,519 | 10/1992 | Ifkovits, Jr. | 271/35 X |

FOREIGN PATENT DOCUMENTS

| | | | |
|---|---|---|---|
| 58-135041 | 8/1983 | Japan | 271/35 |

*Primary Examiner*—David H. Bollinger
*Attorney, Agent, or Firm*—Charles R. Malandra, Jr.; Melvin J. Scolnick

[57] ABSTRACT

A drive unit for a document feeding machine having: a paper feeding module having a pair of support railings; and a modular drive unit. The drive unit includes: a shaft journaled in the support railings; a conveying belt mounted on the shaft for conveying documents from an upstream position to a downstream position, the upper reach of said belt defining a feed path; a cross bar extending between and removably secured to the pair of support railings; a drive unit support plate secured to the cross bar; and a motor for driving the conveying belt secured to the support plate. When the cross bar is detached from the pair of support railings, the drive unit support plate, the motor and one end of the conveying belt drop below the feed path to facilitate repair of the modular drive unit.

5 Claims, 4 Drawing Sheets

MODULAR DOCUMENT FEEDER DEVICE

BACKGROUND OF THE INVENTION

The instant invention relates to document feeding apparatus, and more particularly to a modular drive unit removably housed in such feeding apparatus.

Mechanisms for the feeding of paper documents generally fall into two categories, those being vacuum fed and friction fed. The following description of the prior art will deal only with those types of feeders and material handlers which are considered to be friction-type feeders and which include singulators.

Friction feeders are preferred when it comes to feeding single paper documents. Friction feeders, as the name implies, rely on the interaction of several components that result in the singulation of paper documents. Two methods of singulation are provided by friction feeders. One style is via top feed and the second style is via bottom feed. A friction feeder is designed to operate as a top feed or a bottom feed, but it cannot operate in both modes. The components are usually a drive roller and a retarding device. The retarding device is of a material which provides a high coefficient of friction between the paper being fed and the drive roller.

In a bottom feed configuration, the paper begins as a vertical stack placed on a plurality of belts which usually are supported by a feeder table. This plurality of belts then advance the stack of paper toward a retarding device. As the plurality of belts advance the stack of paper under the retarding device, the friction between the belts and the bottom of the stack of paper tends to pull paper off the bottom of the stack. The retarding device provides the friction that acts to hold back the stack of paper. Therefore, the number of paper documents that are pulled from the bottom of the vertical stack is determined by the physical distance between the belts and the retarding device. If the distance is substantially the thickness of a single piece of paper, or the thickness of the material being singulated, a single paper will be delivered from the bottom of the stack. The single sheet delivery is generally the desired result. If the distance between the belts and the retarding device is the thickness of several pieces of paper or of the documents to be singulated, then a stream of paper documents will be delivered from the stack.

The drive system for friction feeders generally is run off a main drive for the document feeding system of which the friction feeder is a component. A substantial number of belts, pulleys and clutches are typically employed to drive the friction feeder. In operation, it is not uncommon for the friction feeder drive to develop problems, which can cause lengthy shutdowns of the friction feeders and document feeding system. Moreover, it is a time consuming effort to repair the friction feeder drive because of its connection to the main drive for the document feeding system. Moreover, the prior art drive systems are so remote from the effecting feed belts and rotating members that deflections and other undesirable effects are introduced to the feeding components.

Accordingly, the instant invention provides a modular drive unit for a document feeder which can be easily removed for effecting repairs thereto without involving the drive system for the document feeding system, and because of its stability does not introduce deflections and other undesirable effects to the feeding components. Moreover, it is possible to replace the drive unit with a different type if so desired.

SUMMARY OF THE INVENTION

Accordingly, the instant invention provides a drive unit for a document feeding machine. The drive unit includes: a paper feeding module having a pair of support railings; and a modular drive unit. The drive unit includes: a shaft journaled in a pair of side frames; a conveying belt mounted on the shaft for conveying documents from an upstream position to a downstream position, the upper reach of said belt defining a feed path; a cross bar extending between and removably secured to the pair of support railings; a drive unit support plate secured to the cross bar; and a motor for driving the conveying belt secured to the support plate. When the cross bar is detached from the pair of support railing, the drive unit support plate, the motor and one end of the conveying belt drop below the feed path to facilitate repair of the modular drive unit.

DETAILED DESCRIPTION OF THE PREFERRED EMBODIMENT

Figure 1:
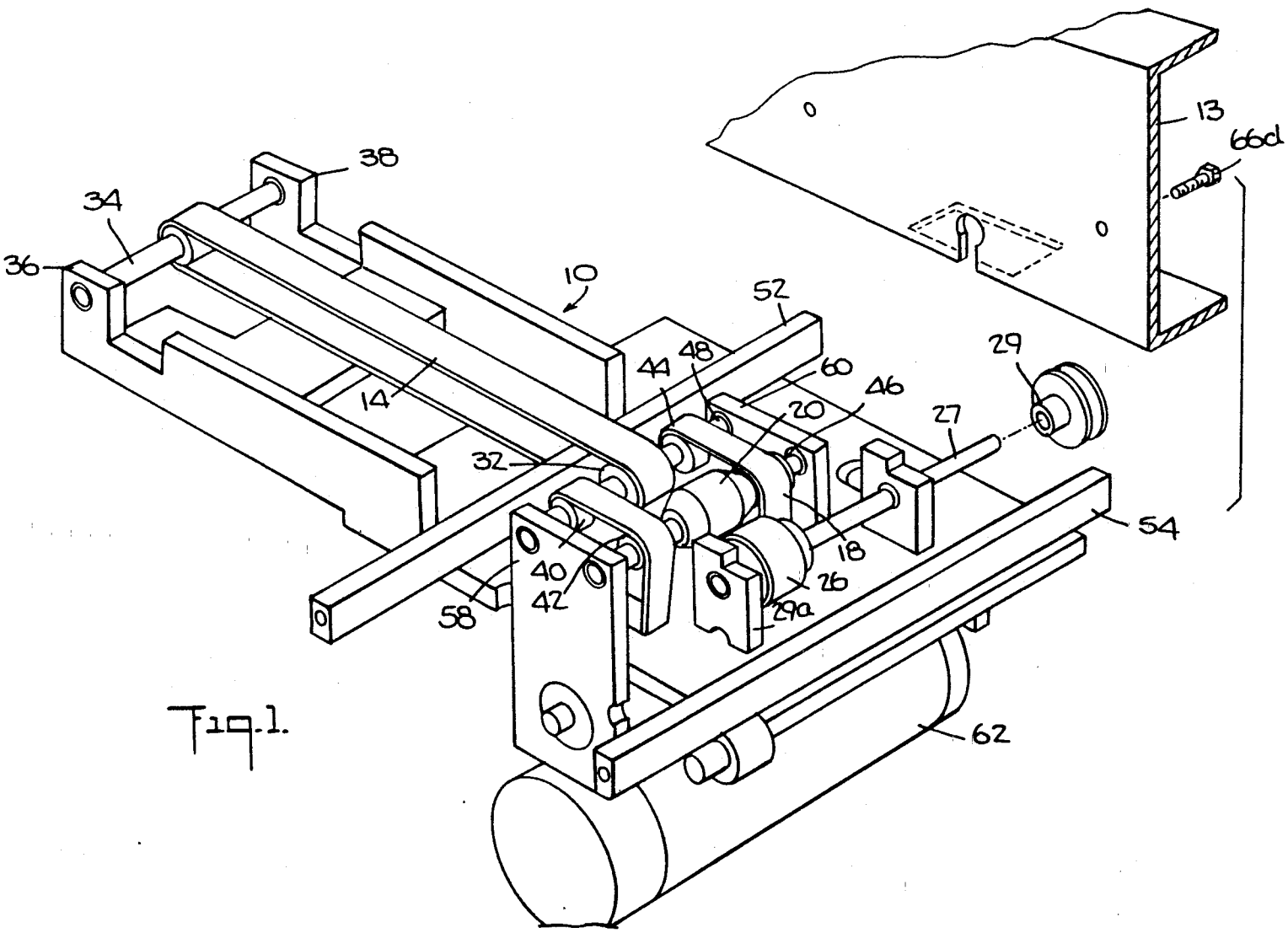
FIG. 1 is a perspective view of a feeder drive unit in accordance with the instant invention.
Figure 2:
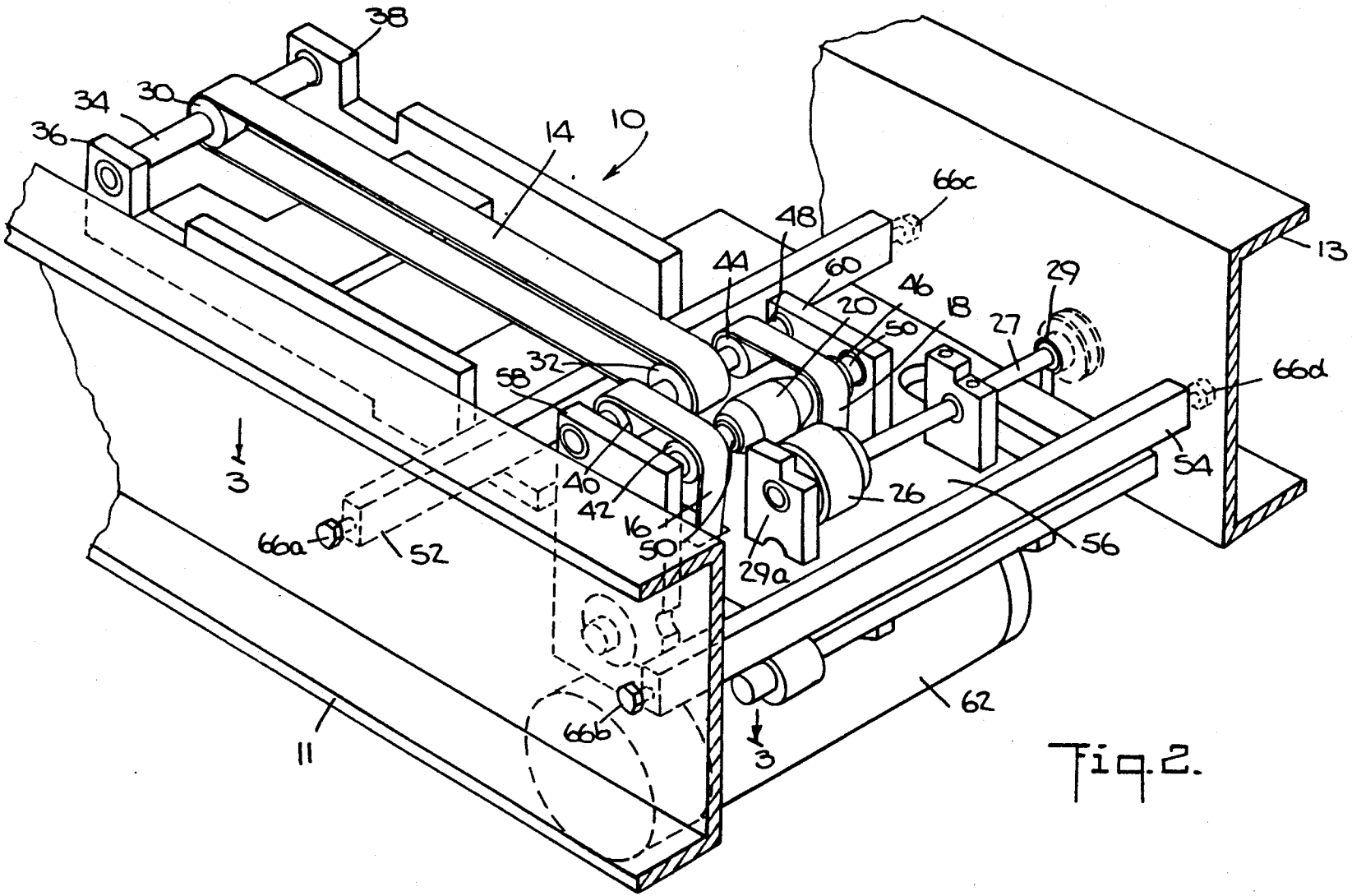
FIG. 2 is similar to FIG. 1 but shows the drive unit secured to a document feeder housing.
Figure 3:
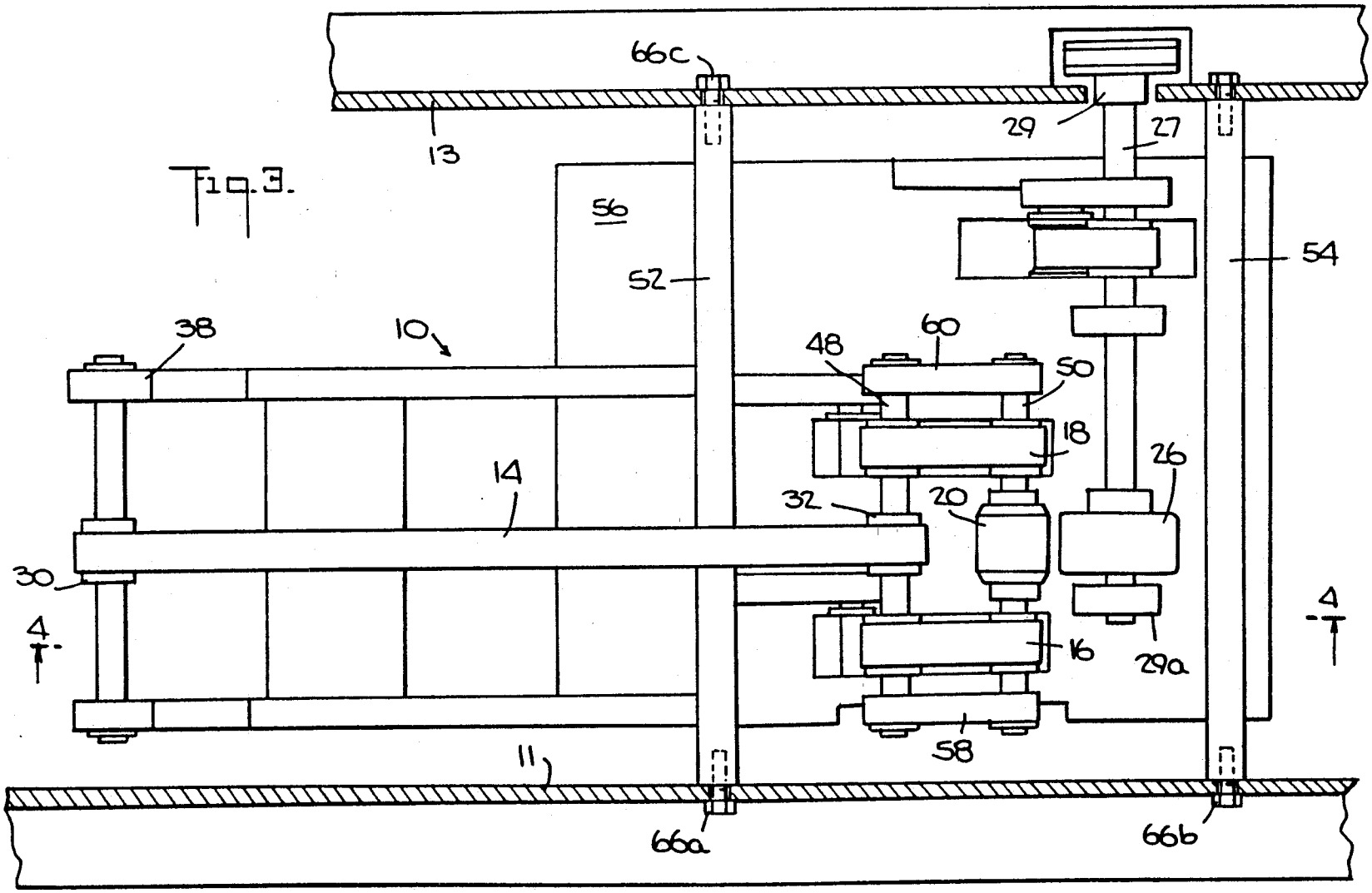
FIG. 3 is a sectional view taken on the plane indicated by the line 3—3 in FIG. 2.
Figure 4:
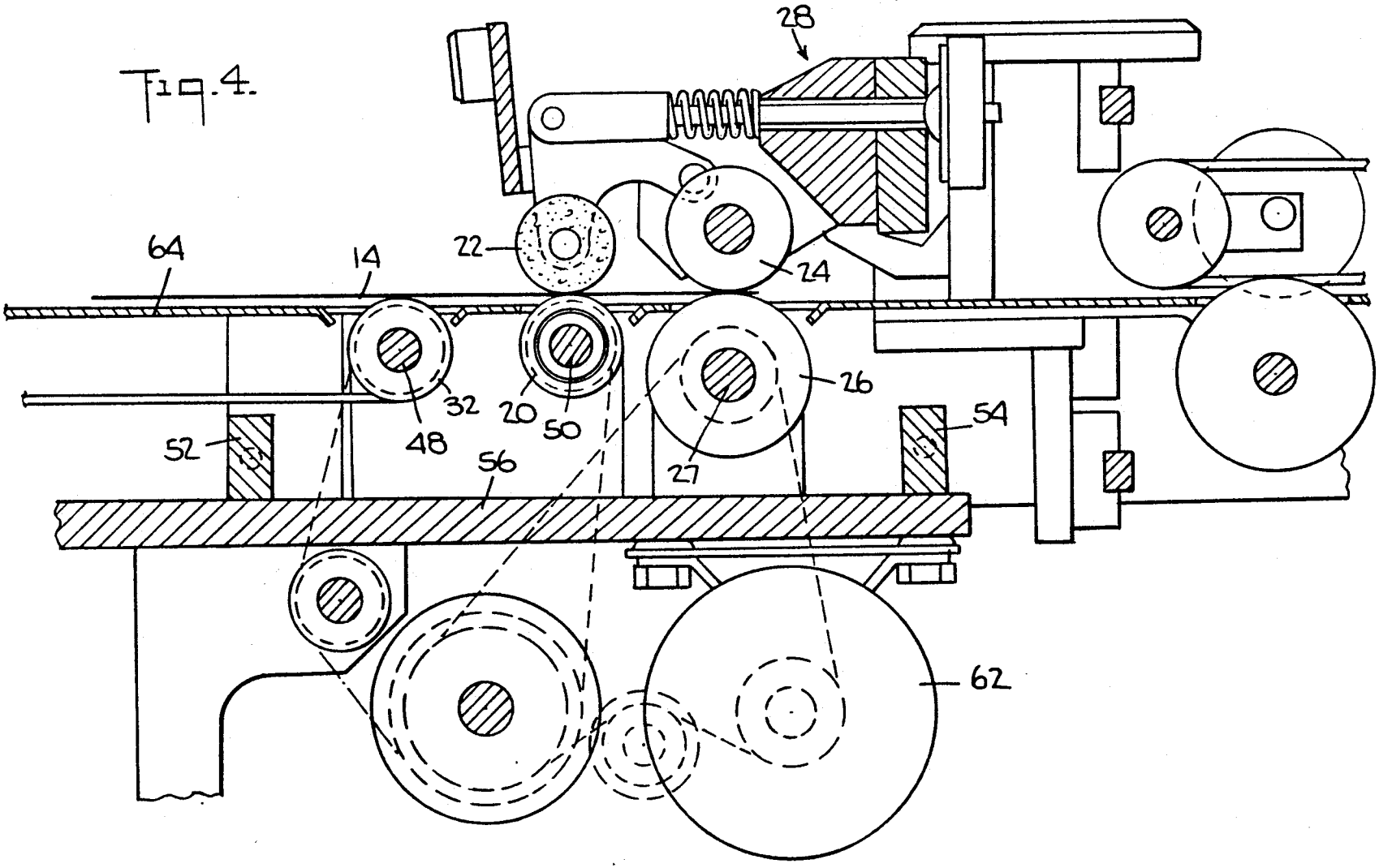
FIG. 4 is a sectional view taken on the plane indicated by the line 4—4 in FIG. 3.

In describing the preferred embodiment of the instant invention, reference is made to the drawings, wherein there is seen in FIG. 2 a paper feeding module 10 for feeding and singulating a stream of paper sheets (not shown) from an upstream position to a downstream position where they are further processed and ultimately inserted into an envelope. The module 10 includes a pair of railings 11 and 13. An intermittently driven belt 14 feeds the sheets toward a pair of intermittently driven belts 16 and 18. At the downstream end of the belts 16 and 18 are a separating roller 20 and a separating stone 22 located above the roller 20 (see FIG. 4). The separating roller 20 is intermittently driven in the same manner as the belts 14, 16 and 18, and is discussed in detail hereinbelow.

Downstream of the separator stone 22 are a pair of continuously running take-away rollers 24 and 26 for conveying the sheets of paper downstream in singulated fashion. The upper take-away roller 24 and the separator stone 22 are mounted in a pivotable housing generally designated 28. The lower take-away roller 26 is mounted on a shaft 27 which is journaled in a pair of support flanges **29*a* and 29*b*. Shaft 37 extends through a slot 31 in the railing 13 and has a pulley 33** mounted on its far end.

The driven belt 14 is mounted on a pair of pulleys 30 and 32. The pulley 30 is mounted on a shaft 34 which is journaled in a pair of side frames 36 and 38. The shaft 34 provides a cantilever point for the side frames 36 and 38 to be discussed further hereinbelow.

The belt 16 is mounted, in its upper reaches, on pulleys 40 and 42, while the belt 18 is mounted, in its upper reaches, on pulleys 44 and 46. The pulleys 40 and 44 are mounted on a shaft 48, while the pulleys 42 and 46 are mounted on a shaft 50. Extending between the railings 11 and 13 are two cross bars 52 and 54. A drive unit support plate 56 is secured to the two cross bars 52 and 54 and supports the side frames 36 and 38 which are secured to the support plate 56. The shafts 48 and 50 are journaled in a pair of supporting flanges 58 and 60 which are secured to the plate 56, which also supports the flanges 29*a* and 29*b*.

A motor 62 is secured to the underside of the support plate 56 and drives the aforementioned belts 14, 16 and 18, the separating roller 20 and the take-away rollers 24 and 26.

If it becomes necessary in the course of operating the paper feeding module 10 to effect repairs to the drive unit, it is a simple matter to remove the paper deck 64 (see FIG. 4) by loosening a few screws (not shown), and then remove four bolts 66 *a–d* (see FIG. 2) from the cross bars 52 and 54. An opening 35 is provided in the bottom of the railing 13 which, along with the slot 31, permits the shaft 27 and pulley 33 to be lowered with the feeder module 10. Thus, removal of the four bolts 66 *a–d* allows the two cross bars 52 and 54 together with the support plate 56 and all of the components of the drive system described above to drop below the level of the deck 64 by cantilevering about the shaft 34.

While the invention has been described in conjunction with specific embodiments thereof, many alternative, modifications and variations will be apparent to those skilled in the art. It is intended to embrace all such alternatives, modifications and variations that follow within the spirit and scope of the appended claims.

What is claimed is:

1. A modular feeding apparatus for a document feeding machine, comprising:

a. a paper feeding module having a pair of support railings; and b. a modular drive unit having (i) a first shaft journaled in a pair of side frames;

(ii) a conveying belt mounted on said shaft for conveying documents from an upstream position to a downstream position, the upper reach of said belt defining a feed path;

(iii) a cross bar extending between and removably secured to said pair of support railings;

(iv) a drive unit support plate secured to said cross bar; and (v) a motor for driving said conveying belt secured to said support plate, whereby when said cross bar is detached from said pair of support railings, said drive unit support plate, said motor and one end of said conveying belt drop below said feed path to facilitate repair of said modular drive unit.

2. The drive unit of claim 1, additionally comprising a pair of supporting flanges secured to said drive unit support plate.

3. The drive unit of claim 2, additionally comprising a second shaft journaled in said supporting flanges for supporting the downstream end of said conveying belt.

4. The drive unit claim 3, additionally comprising a third shaft downstream of said second shaft, said third shaft journaled in said supporting flanges, and a pair of belts downstream of said conveying belt, said pair of downstream belts mounted on said second and third shafts.

5. The drive unit of claim 4, additionally comprising a separating roller mounted on said third shaft intermediate said pair of downstream belts.

* * * * *